US005237762A

United States Patent [19]

Sandberg

[11] Patent Number: 5,237,762

[45] Date of Patent: Aug. 24, 1993

[54] GRABBING DEVICE

[76] Inventor: Stig Sandberg, Skogsbrynsvägen 3, 741 00 Knivsta, Sweden

[21] Appl. No.: 834,224

[22] PCT Filed: Aug. 16, 1990

[86] PCT No.: PCT/SE90/00532

§ 371 Date: Feb. 18, 1992

§ 102(e) Date: Feb. 18, 1992

[87] PCT Pub. No.: WO91/02852

PCT Pub. Date: Mar. 7, 1991

[30] Foreign Application Priority Data

Aug. 22, 1989 [SE] Sweden ..... 8902796

[51] Int. Cl.[5] ..... E02F 3/413

[52] U.S. Cl. ..... 37/468; 37/403; 37/903; 414/723; 414/724; 414/912

[58] Field of Search ..... 37/2 R, 2 P, 117.5, 37/DIG. 3, DIG. 12; 294/2; 414/723, 724, 912

[56] References Cited

U.S. PATENT DOCUMENTS 4,268,217 5/1981 Perreault et al. ..... 414/912 X
4,297,799 11/1981 Sonerud ..... 37/117.5 X
4,355,476 10/1982 Engkvist ..... 37/DIG. 3 X
4,515,522 5/1985 Sonerud ..... 414/724 X
4,779,364 10/1988 Holmdal ..... 37/117.5
4,958,981 9/1990 Uchihashi ..... 414/723 X

FOREIGN PATENT DOCUMENTS 411467 12/1979 Sweden .
416338 12/1980 Sweden .
428138 6/1983 Sweden .
439173 6/1985 Sweden .

*Primary Examiner*—David H. Corbin
*Assistant Examiner*—Arlen L. Olsen
*Attorney, Agent, or Firm*—Shapiro and Shapiro

[57] ABSTRACT

A grabbing device (14) of a type to be connected to an arm or boom of an excavating machine of the like is arranged as separate unit having coupling means for optional coupling thereof to the bucket or the like tool (33) arranged adjacent to or beyond the grabbing device. The grabbing device may be used both with the bucket attached and without same and the bucket or the like unit may be used coupled beyond the grabbing device or directly to coupling means of the arm or boom (1). Between the grabbing device and the coupling means of the arm or boom there is interconnected a rotation tilting apparatus (6) allowing swinging and tilting of the grabbing device (14) relative to the arm or boom (1) and its coupling means.

7 Claims, 3 Drawing Sheets

GRABBING DEVICE

BACKGROUND OF THE INVENTION

This invention relates to a grabbing device of the type carried by an arm or boom of an excavating machine or the like.

SE-A 7900040-0 and 7714027-5 disclose grabbing devices or means directly attached to an excavating bucket. Grabbing arms attached to an excavating bucket—symmetrically grabbing as according to the first mentioned publication or grabbing otherwise—make it possible to use the excavator bucket for grabbing and lifting of objects, e.g., pipes, poles and the like. As the grabbing arms are arranged at the rear side of the bucket, the bucket must be swung into a back position before the grabbing arms can be brought to engage, say, a pipe lying on the ground, resulting in the grabbing area being concealed to the operator by the bucket. Furthermore, the machine arm will be constantly biassed by the weight of the bucket as well as by that of the grabbing device. As a medium size bucket may have a weight of 1,000 kgs or more, it is easily seen that already on idling very heavy weights are handled.

It also must be noted that today a large number of bucket types are available, e.g., narrow buckets for pipe or cable trench digging, wide ones for light material handling, buckets with a V-shaped bottom and a variety of other special types. It is in no way so that the demand for a grabbing device is restricted and related to a specific bucket type.

Another aspect in connection with grabbing devices directly mounted at a bucket is that the bucket and the grabbing device hardly can be expected to have the same service life. As a rule the bucket will be worn out earlier and then the choice would be between repeatedly repairing the bucket far beyond the normal and economically motivated limit in order to have an at least passably functioning carrier for the grabbing device, or discarding or scrapping the grabbing device prematurely together with the bucket.

A bucket equipped with grabbing arms but otherwise arranged in a conventional manner is, in the same way as ordinary buckets, only movable relative to the excavator arm about a transversely arranged axis and this fact results in that, in order to grab, e.g, a pipe positioned more or less tangentially relative to the center of pivot of the excavator, the entire machine must be operated and moved s that the vertical pivot plane of the arm becomes essentially parallel with the longitudinal direction of the pipe. This, naturally, involves a waste of time and in many instance makes the grabber arms useless, resulting in that lifting slings, chains or the like have to be used for changing the position of the object to be lifted.

Besides the fact that the operator's view is obstructed by the bucket of the known systems and grabbing ca take place in certain positions only, the possibilities for orienting a lifted object into a given position or moving the same toward a predetermined mounting position are extremely limited. Without moving the excavator itself, displacement of objects is possible only in the direction of the arm or boom in known machine arrangements.

SE-A-8901884-0 discloses a device adapted to be intercoupled between an excavator boom or arm and a bucket or the like tool, and such device is so arranged as to allow turning of the bucket around an axis oriented essentially in the length direction of the boom and tilting around an axis in the plane of movement of the boom. By this arrangement, the bucket may be made to work sideways or obliquely and may furthermore be tilted relative to the boom in order to make possible digging at slopes and the like in spite of the fact that the excavator machine stands in position in which conventional bucket connecting means would make digging quite impossible.

In the device according to this invention, a similar rotation and tilting apparatus is utilized for a quite new purpose.

SUMMARY OF THE INVENTION

An object of this invention is to provide a device which, besides the utilized functions of known devices, increases the grabbing area and positions of the grabbing arms considerably, eliminates the drawback of having to keep attached the operator's view over the working area obstructing bucket, and enables a wider field of use by the possibility of combining the device with arbitrary tools at the same time allowing the device to be disconnected from the excavator on using the excavator for other purposes.

Another object is to make it possible to attach a grabbing device directly at the tool holder of the excavator and thereby refrain from utilizing the rotation and tilting arrangement. The grabbing device will then be directly carried by the excavator arm via its standardized tool coupling. On attaching and detaching, the couplings for the hydraulic system will have to be manually coupled and uncoupled.

BRIEF DESCRIPTION OF THE DRAWINGS

In the following the invention will be described in detail with reference to the accompanying drawings, in which.

DETAILED DESCRIPTION OF THE INVENTION

Figure 1:
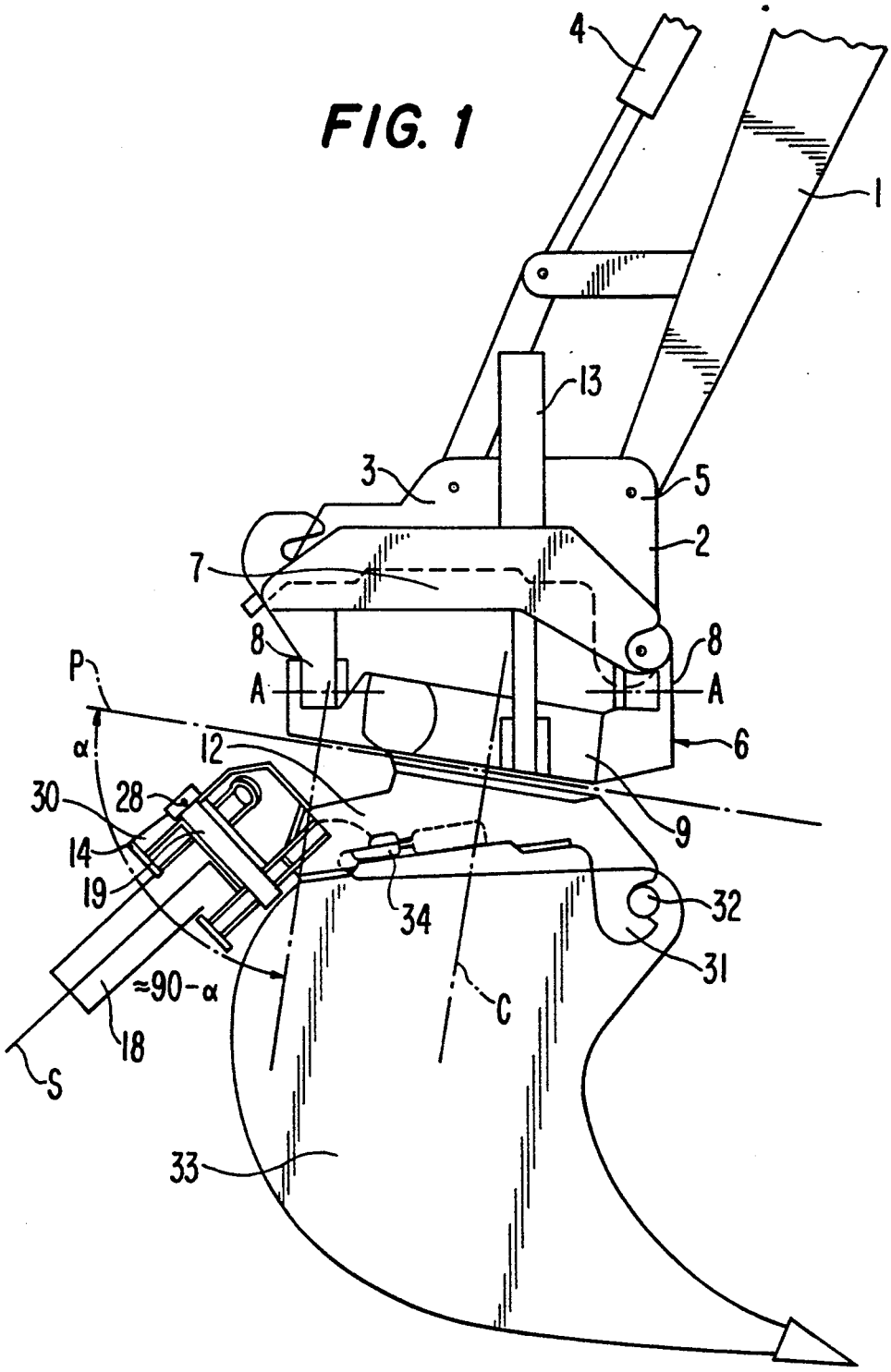
FIG. 1 is a side showing the device according to this invention mounted between a rotation and tilting arrangement attached to a boom or arm of an excavating machine and a bucket.

Referring to the drawings, at the outer end of an only partially shown excavator arm 1, there is arranged an essentially conventional rotation arrangement 2. This arrangement carries an end part 3 which, by means of a hydraulic cylinder and piston arrangement 4, is rotatable relative to the arm around an axis 5 extending in a direction transverse to the arm and in parallel with the axis connecting the arm arrangement to the chassis of the excavator.

A rotating and tilting apparatus, as a unit designated 6, is mounted at the end part 3 by means of today conventional quick coupling means. This apparatus allows full turning or rotation and sideways tilting of a unit attached or coupled thereto (e.g., an excavating bucket or the like) and includes a base plate 7 disconnectably attached to the end part 3 of the arm 1 and equipped with bearings 8 for a yoke part 9, to which a turnplate 10 (FIG. 4) is attached. The turnplate unit has a lower also turnable portion 11, to which is attached a coupling part, the construction and function of which will be described below.

The yoke part 9 with the turnplate 10 with attached and carried units are, by means of cylinder and piston units 13 intercoupled between the base plate and the turnplate unit and a not-shown pressure medium actuated rotator device, tiltable around an axis A through the bearings 8 and rotatable around the central axis C of the turnplate 10.

The grabbing device according to the invention, as a unit designated 14, is, by means of a coupling device 12, arranged at the rotating and tilting apparatus 6 at its side remote from the arm 1.

The grabbing device 14 includes a box-like frame, made from two sturdy spaced plates 15 mutually connected by inner and outer flange plates 16. Inside the box-like frame there is, between the plates 15, a space 17 for a pair of grabbing arms designated 18. The grabbing arms 18 are arranged as double arm levers each carried by a bearing pin 19, which for reasons given below is axially displaceably carried by the frame. The outwardly projecting portion of each arm forms the actual grabbing portion of the arm, whereas the portion on the opposite side forms an abutment for a corresponding cylinder and piston device 20 (only one being shown, by dashed lines, in FIG. 2) which causes the arm to move into and during the active position. The cylinder and piston devices 20 are connected by quick couplings to pipes, each of which via a swivel joint at the rotation and tilting apparatus 6 is connected to the hydraulic system of the machine and its control means.

So-called pilot-controlled check valves 35 are arranged at the connection for the cylinder and piston devices for safeguarding parallel movements at the grabber arms. They furthermore result in a self-locking effect so that the grabber arms are caused to remain in positions reached by the cylinder and piston devices in case of pressure loss.

Figure 3:
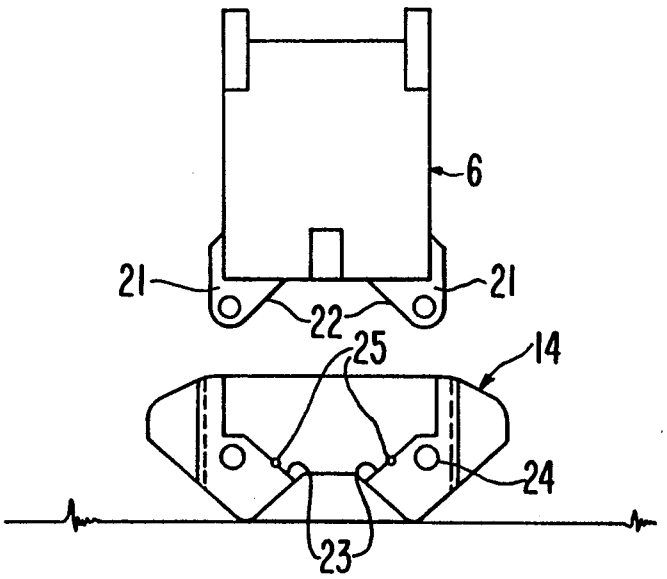
FIG. 3 is a front view of the rotation and tilting arrangement together with the device according to this invention in a pre-coupling position.

The coupling part 12 can, as already mentioned, be found at the rotatable part 11 of the turnplate and this part has—as can be seen in FIG. 3—at one end two protruding ears 21 arranged to cooperate with connecting devices of various types of tools. The holed ears have inside edges 22 at a right angle to each other. At one end of the grabbing device there are pockets 23 formed by perforated (at 24) plates welded to the end portions of the flange plates 16. The spaces available for the ears at each pocket are defined inwardly by pins 25 traversing the pocket openings.

Figure 4:
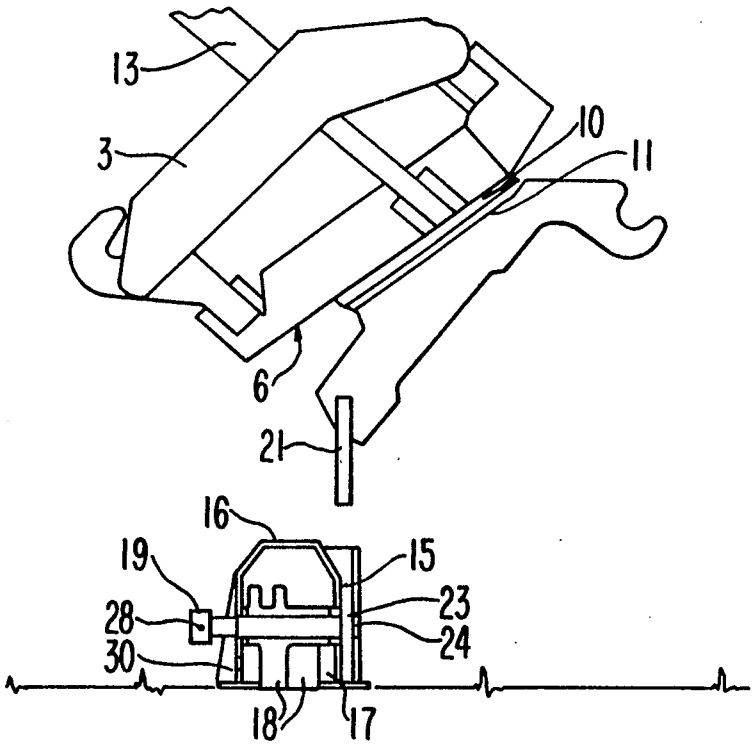
FIG. 4 shows the arrangement according to FIG. 3 from one side.

On assembling, shown in FIGS. 3 and 4, the ears 21 are introduced into the pockets 23 so that the oblique inside edges 22 of the ears engage the pins 25 and align the ears correctly each one in its pocket simultaneously as they serve as additional abutments. On reaching this position, locking together is achieved by moving the bearing pins 19 so that they traverse each pocket 23 and pass through the hole 24 in each outer plate. In the embodiment shown, the movement of the pins is achieved manually, but in an alternative embodiment hydraulic control devices may be engaging the pins 19. The pins 19 have radial through bores 28 for a locking rod 29. In the outwardly displaced position, the rod runs outside bracing plates 30, but in the inwardly displaced locking position through not-shown bores in the same plates. In the embodiment having hydraulic controlled pins, the locking may be achieved in another appropriate way.

When the bearing pins 19 are in their inwardly displaced position and locked by the rod 29, the grabbing device is securely anchored to the rotation and tilting apparatus.

Figure 2:
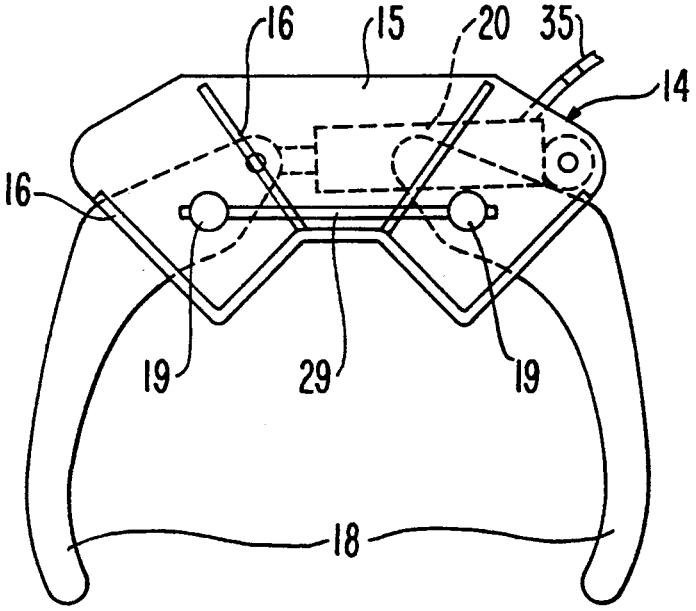
FIG. 2 shows the device, as seen obliquely from above, disconnected and with the grabbing arms in a grabbing position.

From especially FIGS. 1 and 2, it can be seen that the grabbing device is mounted obliquely relatively to the axis C of the turnplate unit and to the plane P, within which the rotatable parts are rotatable. The reason behind this is as follows. If a mounting similar to the one shown in the patent referred to (i.e., where the pivot axes of the grabbing arms are parallel with the rear side of the bucket) were used, one would find that, in spite of the rotatability, blind sectors occur in certain positions of rotation due to the fact that the maximum achievable angle of movement for the tilting apparatus cannot exceed 40–50°.

In certain sectors it would also be impossible to reach the ground with the grabbing arms.

Even if the grabbing device instead was so arranged that the pivot axes of the arms were at right angles to the axis of rotation, the same problems would result. That is, dead or blind sectors where the arms do not reach the ground will be the result.

In order to eliminate the above mentioned drawbacks, the grabbing device according to this invention is obliquely arranged relative to the rotational axis C or plane P, and most preferably so that radial planes through the mutually parallel axes of the grabbing arms lie at about a 40–50° angle relative to the plane P of rotation around the axis C. FIG. 1 shows in dashed lines how the pivot plane S of the grabbing arms forms an angle relative to the plane P of the rotation and tilting apparatus. As is also shown in FIG. 1, the largest angle to which pivot plane S of the grabbing arms may be displaced by means of the cylinder and piston arrangement 4 is (including the oblique angle $\alpha$ of the pivot plane S) 90° relative to the illustrated position of the plane of rotation P of the rotation and tilting apparatus.

The dead or blind sectors are eliminated by the arrangement described and the grabbing device can function independent of the rotational position.

As the drawing figures show, there are at the rotation and tilting apparatus another set of attachment means or connectors. These include hooks 31, intended to cooperate with transverse abutment studs 32 of a bucket or the like 33, and a locking wedge means 34 movable by means of a cylinder and piston arrangement, the wedge means being arranged so as to wedge engage a cooperating fitting on the upper side of the bucket to lockingly secure the same. The features just mentioned are per se known and make it possible to attach a bucket beyond the grabbing device as shown in FIG. 1, so that the bucket may be used in a conventional manner.

If the grabbing device only is to be used, it is normally advantageous to disconnect the bucket and put it aside as otherwise also the weight of the bucket, up to and even exceeding 1,000 kg, reduces the pay-load which may be handled by the grabbing device. For the same reason, it is possible, if only excavating is at hand, to disconnect the bucket and the grabbing device and to disconnect the latter from the rotation and tilting apparatus and connect the bucket directly to the same.

The fact that the grabbing device is carried by the rotation and tilting apparatus makes it very movable and it is possible to grab in all directions without problems and also to handle and position the load carried.

The latter is of importance especially in pipe laying work as the operator may put the pipes down into the dug pit aligned and in correct position and further move the pipes towards already put down pipes in order to achieve an interconnecting of the same. For such moving together, advantageous use may be made of non-circular cross section sealing rings, which during the moving together procedure, roll and pass a position of equilibrium and then with snap action pull the pipes together. Conventional pulling together tolls normally required are, thus, rendered superfluous.

I claim:

1. A grabbing device for attachment to a rotating and tilting mechanism arranged on a boom of an excavating machine to rotate and tilt an attachment relative to the boom, said grabbing device comprising:

a pair of grabbing arms; arm supporting means supporting said grabbing arms for movement toward and away from one another to perform grabbing and releasing; mounting means for attaching said arm supporting means to the rotating and tilting mechanism to enable rotating and tilting of said arm supporting means, and therefore of said pair of grabbing arms, relative to the boom; said mounting means including means for mounting a standard excavating tool detachably thereon and together with, but independently of, said arm supporting means, such that said grabbing device may be attached to the rotating and tilting mechanism with or without the standard excavating tool, selectively.

2. A grabbing device according to claim 1, wherein said arm supporting means is detachable from said mounting means, such that the standard excavating tool may be attached to said rotating and tilting mechanism with or without said grabbing arms, selectively.

3. A grabbing device according to claim 1, wherein said mounting means mounts said arm supporting means to the rotating and tilting mechanism such that said grabbing arms move toward and away from one another substantially in a plane which is oblique with respect to a rotational plane and a rotational axis of the rotating and tilting mechanism.

4. A grabbing device according to claim 3, wherein the rotating and tilting mechanism is supported for movement about a pivot axis transverse to the boom of the excavating machine and wherein said oblique angle is such that said plane of movement of the grabbing arms can be brought to an angle of about 90° relative to a predetermined position of the rotational plane of the rotation and tilting mechanism.

5. A grabbing device according to claim 3, wherein said arm supporting means includes frame means defining a chamber for receiving portions of said grabbing arms and housing a pair of fluid actuated cylinder and piston devices each pivotably coupled to a respective one of said grabbing arms by a corresponding pivot pin mounted in holes in walls of said frame means.

6. A grabbing device according to claim 5, wherein said frame means has outwardly open pockets adjacent to the response pivot pins and wherein said mounting means includes a coupling part having respective ears of complementary shape to said pockets for receipt within said pockets and having holes which align with the holes of said walls to receive the respective pivot pins.

7. A grabbing device according to claim 5, further comprising pilot-controlled check valve means coupled with said cylinder and piston devices for ensuring that the movements of said grabbing arms parallel one another and for locking said grabbing arms in position in response to a loss of fluid pressure to said cylinder and piston devices.

* * * * *